United States Patent [19]

Zilka

[11] 4,211,352

[45] Jul. 8, 1980

[54] NAILING MACHINE

[76] Inventor: Thomas J. Zilka, 15 Escalon Dr., Mill Valley, Calif. 94941

[21] Appl. No.: 14,843

[22] Filed: Feb. 26, 1979

[51] Int. Cl.[2] ..... B25C 1/04

[52] U.S. Cl. ..... 227/130; 91/5; 227/156

[58] Field of Search ..... 227/130, 120, 156; 91/5, 461

[56] References Cited

U.S. PATENT DOCUMENTS

| | | | |
|---|---|---|---|
| 684,019 | 10/1901 | Wepplo | 91/5 |
| 3,026,849 | 3/1962 | Powers et al. | 91/5 X |
| 3,049,712 | 8/1962 | Khan | 91/5 X |

*Primary Examiner*—Paul A. Bell
*Attorney, Agent, or Firm*—Melvin R. Stidham

[57] ABSTRACT

A pneumatic, linear thrust hand tool, such as a nail driver wherein a charge of pressurized gas in a firing chamber acts, when a main valve is opened, to drive a ram downward. The main valve is opened by a higher pressure source gas entering a charging chamber under a piston carried on the valve stem. Then a control valve is released, the pressurized gas under the piston is delivered to the main cylinder to return the ram and, when the main valve is closed, the pressure in the firing chamber is equalized with that in the charging chamber to prepare it for the next "firing".

9 Claims, 3 Drawing Figures

NAILING MACHINE

BACKGROUND OF THE INVENTION

Most pneumatic tools are cumbersome to handle and require an air compressor or other source of large quantities of pressurized gas. As a result, they also require lengthy hoses to minimize required movement of the air compressor.

OBJECTS OF THE INVENTION

It is an object of this invention to provide a pneumatic hand tool which is convenient to handle and which effects efficient use of available pressurized gas.

It is a further object of this invention to provide a pneumatic hand tool which can operate efficiently and at length on a small container of pressurized gas.

Other objects and advantages of this invention will become apparent from the description to follow, particularly when read in conjunction with the accompanying drawing.

SUMMARY OF THE INVENTION

In carrying out this invention, I provide a cylinder with a ram therein carrying a plunger to apply a linear thrust, as to drive a nail. A large valve to one end of the cylinder opens to a firing chamber containing a charge of pressurized gas. The valve is opened by a valve actuator piston which is slidable in a cylinder wholly contained within another, charging chamber above the firing chamber. When a control valve is operated, gas from a source is introduced under the piston and, after the piston lifts the valve off its seat, the gas flows around the piston to fill the charging chamber. Then, when the trigger is released, the control valve moves to its normal position wherein the gas previously trapped below the main valve actual piston is released and directed to the main cylinder below the ram to return it to its starting position. Then, when the main valve is closed, a pressure equalizing valve contained in the main valve stem equalizes pressures in the charging and firing chamber. Hence, a single charge of the source gas is used to open the valve; to return the ram to a starting position; and then to charge the firing chamber.

BREIF DESCRIPTION OF THE DRAWINGS

DESCRIPTION OF PREFERRED EMBODIMENTS

Figure 1:
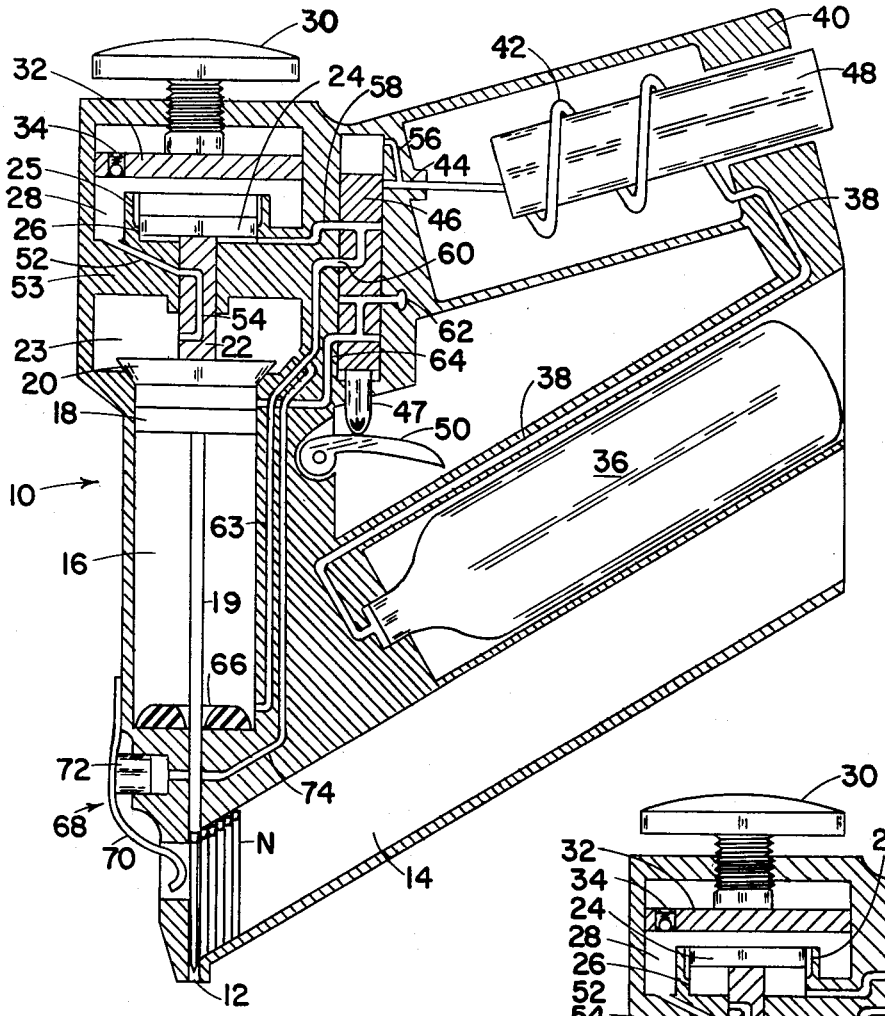
FIG. 1 is a section view of a pneumatic hand tool embodying features of this invention.
Figure 2:
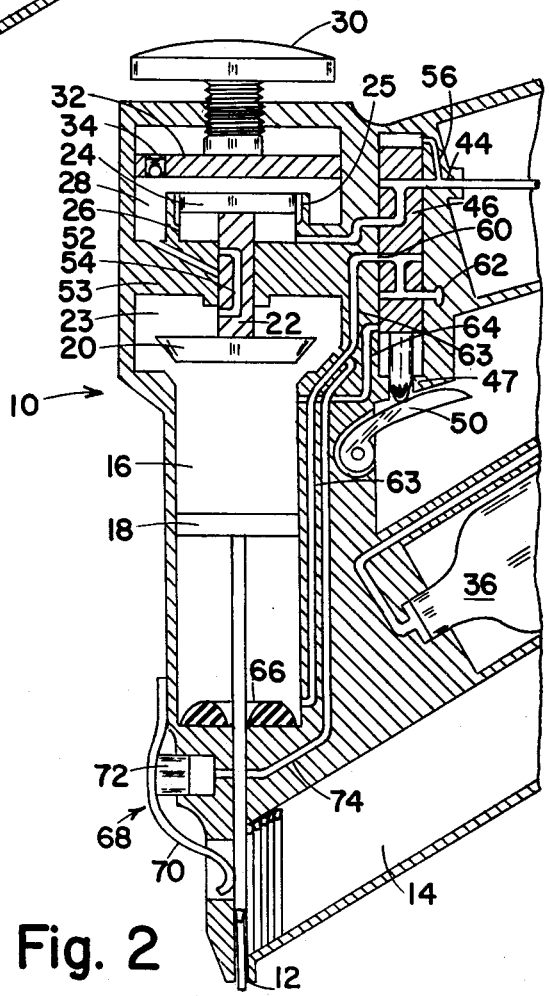
FIG. 2 is a partial section view of the tool in another stage of operation.

The Embodiment of FIGS. 1 and 2

Referring now to FIGS. 1 and 2 with greater particularity, the nail gun 10 of this invention includes a nail discharge barrel 12 for positioning a nail for driving, a nail cartridge 14, a power cylinder 16, and a driving ram 18, which is reciprocable in the cylinder and carries a plunger 19. The power cylinder 16 is normally closed by a poppet valve 20 between it and a firing chamber 23, as shown in FIG. 1. Carried on the stem 22 of the poppet valve 20 is an actuator piston 24 which, when driven upward, raises the poppet valve 20 off of its seat. The actuator piston 24 is reciprocable in an open top, shallow cylinder 26 having by-pass grooves 25 near the upper end thereof. The open top cylinder 26 is contained within a high pressure or charging chamber 28. The volume of the high pressure chamber 28 can be adjusted by threading an adjustment wheel 30 to move a top closure 32 up and down as desired. A check valve 34 in the top closure allows pressure fluid in the chamber 28 to move above the top closure 32 to balance pressure and facilitate adjustment by the control knob 30.

Carried on the gun 10 is a suitable source of pressure fluid such as a cylinder 36 of a high pressure gas. The supply gas may, for example, be bottled carbon dioxide at, say 750 p.s.i., or in the alternative, there may be a hose connection from a remote source of pressure such as an air compressor. In any event, the high pressure gas is delivered through ducts 38 contained in the gun handle 40 and then through tubing of an evaporator coil 42 to the intake 44 of a spool control valve 46. Before entering the control valve 46, the gas passing through the evaporator coil 42 absorbs heat from the surroundings or from a fitted heat source 48, such as a butane lighter or the like.

In the position of the spool 46 shown in FIG. 1, prior to pressing the trigger 50, the high pressure gas inlet 44 is shut off by the spool 46 and the main poppet valve 20 is seated. At this stage the charging and firing chambers 28 and 23 are at the same pressure, being equalized through passage 52 in the wall 53 separating the chambers, and through a duct 54 through the valve stem 22 opening into the intermediate or working chamber 23. Of course, since the same quantity of fluid previously in the charging chamber 28 now occupies both chamber 23 and 28, it is at a pressure lower than source, e.g. 250 p.s.i. Only when the main valve 20 is closed are the ducts 52 and 54 in alignment. Hence the valve stem 22 is, itself, a supply valve for the intermediate pressure or firing chamber 23. When the main valve 20 is closed, pressure fluid in the upper charging chamber 28 flows to the lower firing chamber to load it for the next "firing".

A small bypass duct 56 from the inlet passage 44 biases the control valve spool 46 to its downward position. When in that position, the space below the main valve actuator piston 24 is balanced through ports 58 and 60 with the pressure below the drive ram 18 at near atmospheric pressure with the ram fully raised. The space above the ram 18 is open to atmosphere at 62 through duct 64.

When the trigger is pressed and valve spool 46 is raised to the position shown in FIG. 2, the high pressure gas inlet 44 is opened to the space below the main valve actuator piston 24 raising it, and with it the valve stem 22, to raise the main valve 20 off of its seat. This produces a rush of fluid from the firing chamber 23 into the main drive cylinder 16 to force the ram 18 down. When the actuator piston 24 nears the top of its stroke, the bypass grooves 25 in the shallow cylinder 26 allow the high pressure gas to blow by the piston 24 and pressurize the high pressure chamber 28 to a level close to source pressure, e.g. about 750 psi.

In the meantime the main drive cylinder 16 below the piston is vented to the atmosphere at 62 through passage 63 and port 60, and the port 64 below the main valve 20 is closed off by the valve spool 46. Hence, the drive ram 18 continues down by reason of the pressure differential across it until, finally, the remaining kinetic energy is absorbed in the bumper 66 at the lower end of the cylinder 16.

When the trigger 50 is released, the spool 46 is returned to its lower position by reason of the biasing pressure in bypass duct 56. The high pressure gas in the shallow main valve actuator cylinder 26, which was trapped below the control piston 24 is now released through ports 58 and 60 and conducted through line 63 to the main drive cylinder 16 below the ram 18, driving it back up to its original position shown in FIG. 1. The release of pressure previously trapped below the actuator piston 24 allows the piston to be driven down by the pressure fluid above it in charging chamber 28 carrying the main valve 20 with it to return to its seat. This again opens the equalizing passages 52 and 54 to bring the pressure in the charging and firing chambers 23 and 28 into equalization at the intermediate level, thus preparing the gun for the next operation.

Summarizing, when the valve spool 46 is raised by pressing the trigger the high pressure gas from the source 36 enters under the main valve actuator piston 24 to lift the main valve 20 and cause intermediate pressure in the firing chamber 23 to drive the ram 18 and plunger 19 downward. Then when the actuator piston reaches the level of the by-pass grooves 25, the high pressure fluid escapes around the piston 24 to charge the entire charging chamber 28. Now, when the trigger 50 is released and the valve spool 46 is lowered by pressure in the passage 56, that portion of the high pressure fluid below the actuator piston 24 is released through passage 58 to allow the high pressure fluid remaining in the upper chamber to drive the actuator piston 24 down to the position shown in FIG. 1, wherein the pressures in chambers 28 and 23 are then equalized, through passages 52 and 54, to an intermediate pressure level. This sets the pressure conditions for the next "firing".

In the meantime, the high pressure fluid that was exhausted from below the control piston 24 is delivered through passage 60 to the main cylinder 16 below the ram 18, while the same cylinder above the ram 18 is exhausted through passages 63 and 62 to the atmosphere. This drives the ram upward to the position shown in FIG. 1 and sets the mechanism for the next "firing".

Hence a single charge of high pressure fluid opens the main valve 20 as it charges the chamber 28. Then a portion of it returns the ram 18 to starting position while the remainder loads the firing chamber for the next strike.

As an additional feature of this invention, I provide a device 68 to avoid wasting the first nail for lack of adequate pressure. In order to fill the intermediate chamber 23 with gas at an adequate pressure to drive a nail N, it may require that the trigger be actuated to fire the gun at least once. The blocking device at 68 includes a spring member 70 which holds the nails retracted into the nail feed device 14 unless the pressure in the chamber 23 is high enough to drive the nail properly. A piston 72 biases against the spring 70 under the pressure in chamber 23 by reason of sensing passageway 74. Hence, when the pressure in the firing chamber 23 reaches a sufficiently high level, the piston 72 will retract the spring member 70 and allow a nail to move into place.

Figure 3:
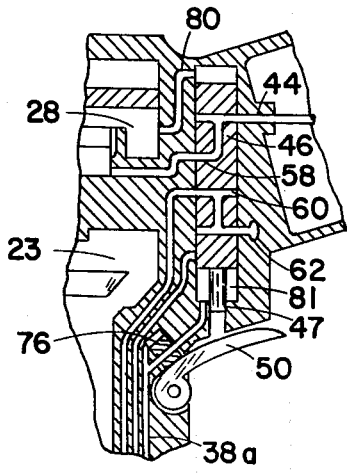
FIG. 3 is a partial section view of an alternative control for the pneumatic tool.

The Embodiment of FIG. 3

Referring now to FIG. 3 the tool is here conditioned as a hammering device. In so adapting it, the ram 18 is replaced by a similar ram which is proportioned for hammering rather than nail driving and the nail feed device 14 would be removed.

In this arrangement, a simple on-off valve 76 is adapted so as to be actuated by the trigger 50, the valve being normally biased toward closed position by supply gas entering through passageway **38*a* from the pressure source 36**.

A passageway 80 opening from high pressure charging chamber 28 biases the control valve spool 46 downward while supply pressure enters chambers 81 below the valve spool 46, when the trigger valve 76 is open, to bias it upward toward the position shown in FIG. 3.

In operation, squeezing the trigger 50 to open the valve 76 permits gas from the source 36 to enter into the chamber 81 below the valve spool 46. This pressure is sufficient to overcome the opposing pressure in chamber 80, at the level of the charging chamber 28, because at this instant, the pressure in chamber 28 has been reduced to equalize chamber 23 through the ducts 52 and 54. Thus, high gas pressure in the lower chamber 81 forces the valve plunger upward to its top position (as shown in FIG. 3) causing the valve actuator 24 to lift the main valve 20 and force the ram 18 to move downward at a high speed, as in the nailing operation described in connection with FIGS. 1 and 2. Then, as the pressure in the upper chamber 28 increases it reaches the magnitude of the supply gas, causing the valve spool 46 to move back down to its lower position, because of the unequal areas at the two ends of the valve spool 46 with the guide plunger 47 at only one end. This initiates the return stroke of the ram 18 as in the nailing operation.

The device is now ready for its second stroke, and if the trigger is held squeezed, the second stroke will occur as soon as the valve has completed its downward movement. The ram 18 will thus reciprocate at a rate resulting from a proper combination of mass of the moving parts and resistence to gas flow in the several passages.

While this invention has been described in conjunction with preferred embodiments thereof, it is obvious that modifications and changes therein may be made by those skilled in the art without departing from the spirit and scope of this invention, as defined by the claims appended hereto.

Having described my invention, I claim:

1. A pneumatic linear thrust hand tool comprising:

a main cylinder;

a ram reciprocable in said main cylinder;

a firing chamber above said main cylinder;

a large main valve operable when opened to bring said main cylinder and said firing chamber into communication;

a charging chamber;

supply valve means for bringing said charging and firing chambers into communication when said main valve is closed;

control valve means operative in one position to connect said charging chamber to a source of pressurized gas; and, a main valve actuator operative in response to flow of gas into said charging chamber to open said main valve.

2. The pneumatic hand tool defined by claim 1 wherein the said valve actuator comprises:

an actuator cylinder contained within said charging chamber;

an actuator piston reciprocable in said actuator cylinder;

charging ports in said actuator ccylinder opening to the interior of said charging chamber;

said charging ports being uncovered by said actuator piston at the outer portion of its stroke;

conduit means for delivering pressurized gas to said charging chamber through a port at one end of said actuator cylinder to drive said actuator piston through said stroke;

means structurally connecting said actuator piston to said main valve to open same through said stroke.

3. The pneumatic hand tool defined by claim 2 wherein said last-named means comprises:

a passageway interconnecting said charging and firing chambers;

a valve stem slidable in said passageway and interconnecting said main valve and said valve actuator piston;

a first duct opening from said charging chamber to said passageway;

a second duct on said valve stem opening from said passageway to said firing chamber, said first and second ducts being in communication when said main valve is closed.

4. The pneumatic hand tool defined by claim 2 wherein:

said control valve means is operative in a second position to connect said one end of the actuator cylinder to said main cylinder below said ram.

5. The pneumatic hand tool defined by claim 1 wherein:

said control valve member is operative in said second position to connect the said main cylinder above said ram to atmosphere.

6. The pneumatic hand tool defined by claim 1 including:

means for adjusting the size of said charging chamber.

7. The pneumatic hand tool defined by claim 1 including:

a hand-operated trigger operatively associated with said control valve:

said control valve being moved to said one position by actuating said trigger; and including:

means biasing said control valve towards said other position.

8. The pneumatic hand tool defined by claim 1 including:

a control valve cylinder;

said control valve being reciprocable in said cylinder;

duct means connecting one end of said cylinder to the source of pressurized fluid and the other end of said cylinder to said charging chamber;

said one end of said control valve being smaller in area than said other end so that when pressures therein are substantually equal said control valve will be biased towards said one position but said differential areas can be overcome by pressure differential when said supply valve is opened to bring the pressure of the charging chamber down to the level of said firing chamber.

9. The pneumatic hand tool defined by claim 1 including:

a plunger carried by said ram;

a nail guide passage at the lower end of said tool for receiving said plunger;

a nail cartridge for feeding a supply of nails to said nail passage way.

* * * * *